US005127720A

United States Patent [19]

Shultz

[11] Patent Number: 5,127,720

[45] Date of Patent: Jul. 7, 1992

[54] LOTTERY TICKET TRAY

[76] Inventor: Florance Shultz, 22951 Ambassador Blvd., Box 370, St. Francis, Minn. 55070

[21] Appl. No.: 605,128

[22] Filed: Oct. 24, 1990

[51] Int. Cl.[5] ..... A47B 96/00

[52] U.S. Cl. ..... 312/229; 206/38; 206/39; 108/45; 211/13; 15/236.01; 15/236.07

[58] Field of Search ..... 312/229, 245; 206/38, 206/39, 246; 108/44, 45; 248/205.2; 211/13; 269/55, 165, 237; 15/236.01, 236.07

[56] References Cited

U.S. PATENT DOCUMENTS

| | | | |
|---|---|---|---|
| 2,170,013 | 8/1939 | Detwiler | 108/45 |
| 2,336,281 | 12/1943 | Morris | 15/236.01 |
| 2,353,391 | 7/1944 | Cotton | 108/45 |
| 2,435,151 | 1/1948 | Morgan | 108/45 |
| 2,616,775 | 11/1952 | Nesbitt et al. | 108/45 |
| 2,621,093 | 12/1952 | Merhige et al. | 108/45 |
| 3,307,740 | 3/1967 | Fant | 248/205.2 X |
| 3,899,982 | 8/1975 | Fetzek | 108/45 X |
| 4,549,327 | 10/1985 | Johnson . | |
| 4,577,788 | 3/1986 | Richardson | 108/44 X |
| 4,654,923 | 4/1987 | Faciane et al. . | |
| 4,662,518 | 5/1987 | Chiappetta et al. . | |
| 4,777,693 | 10/1988 | Diba et al. . | |
| 4,846,382 | 7/1989 | Foultner et al. | 108/45 X |
| 4,881,291 | 11/1989 | Ellis . | |

*Primary Examiner*—Kenneth J. Dorner
*Assistant Examiner*—Brian K. Green
*Attorney, Agent, or Firm*—Haugen and Nikolai

[57] ABSTRACT

A lottery ticket scratch tray is herein provided to promote the clean and efficient removal of opaque coverings shielding lottery ticket variables. The device includes a square or rectangularly shaped smooth surface surrounded by four walls. Built into the device is a slot through which debris from spent tickets may be deposited. This debris stored beneath the smooth surface and may be disposed of through the removal of a slidable drawer which serves as the storage compartment. The device further contains a novel hook-and-loop fastening system to aid in the storage of the device.

2 Claims, 2 Drawing Sheets

LOTTERY TICKET TRAY

BACKGROUND OF THE INVENTION

One reason for the great popularity of scratch-off lottery tickets is that they are freely accessible. The lottery ticket is unique in that unlike other games of chance, such as bingo or any variety of casino games, the product is in the form of a ticket which comes to the consumer, not vice versa. That is to say, scratch-off lottery tickets are sold at establishments such as convenience stores, liquor stores, filling stations, as well as other retail outlets. The buyer of such tickets usually makes his or her purchase as an afterthought, with the ticket usually being bought because it, as well as change in the form of cash, happened to be available at the checkout counter of an establishment which the purchaser patronized. Establishments such as those listed above generally have certain characteristics in common: a steady stream of people, little or no privacy afforded the patron, and a limited amount of area or space.

Another unique aspect of the lottery ticket is the desire of many purchasers to be afforded at least some degree of privacy when conducting the act of exposing the ticket's variables. While there are no known scientific studies which have explored this phenomena, it is reasonable to assume that the typical purchaser does not wish for a stranger to witness the results of his or her gamble for fear that he or she will look the part of a fool when it is shown that his or her lottery ticket yielded the purchaser nothing. Alternatively, the purchaser may fear that he or she will appear foolish if, for example, he or she becomes excited when a token sum is won and reinvested at once in more tickets, on the hope that one of them may contain the numbers or symbols needed to win the maximum lottery prize. One optimal place to be afforded the desired space, comfort, and privacy needed to enjoy and appreciate the act of exposing lottery tickets is the inside of the parked or otherwise disengaged automobile driven by the purchaser to the filling station, convenience store, or liquor store. Unfortunately, scratch-off lottery cards usually employ a latex type surface layer which is to be scraped to expose the hidden indicia. The resulting residue is not only unsightly, but is difficult to remove from fabric and upholstery as well. Further, unless the buyer of the ticket has a hard surface such as a book or the like upon which to scrape the ticket, he or she will likely use, out of necessity, a clumsy surface such as the dash-board or one's knee for under support. Thus, the hard-to-clean residue may end up on the car seat, in the fabric of one's clothes, or in the car's carpeted floor. What is needed is a device which allows for accommodation of one's desire to play the lottery in the privacy of his or her own automobile while insuring that by doing so, he or she will not become uncomfortable or create a mess in the process.

SUMMARY OF THE INVENTION

It is a major object of the invention to provide a device meeting the above need. In general terms, the present device is comprised of a rectangular tray, having a lip which surrounds the entire perimeter of said tray. The tray is of such a size so as to fit comfortably onto one's lap. Said tray is capable of holding several lottery tickets, and it contains a slot into which residue from scraped tickets may be deposited, and a retractable drawer located beneath the tray into which the residue deposited through said slot is stored. Also incorporated into the device are two plastic strips, located at either end of said tray, affixed to the top of said lip. Each of these strips contains the exposed surface of the loop portion of a hook and loop fastening system. Further, one of these strips contains two pins, which serve to create a hinge. With this hinge, the user of the tray is able to secure tickets to the tray in such a way that the act of scraping is made easier. Two strips comprising the hook portion of the hook and loop fastening system are located in an area convenient for user storage. This area may include, but its not limited to, the area directly beneath the dash-board of the automobile. Finally, a scraping device is conveniently and permanently affixed to the tray via a chain.

It is a further object to the present invention to provide an improved receptacle means for accommodating the removal of the concealment film or means from the indicia of a lottery ticket, and to permit gathering and storing of this concealment film or means until it can be properly and conveniently disposed of.

These and other objects and advantages of the invention will be more fully understood when the specifications and drawings are examined.

DETAILED DESCRIPTION OF THE DRAWINGS

Figure 1:
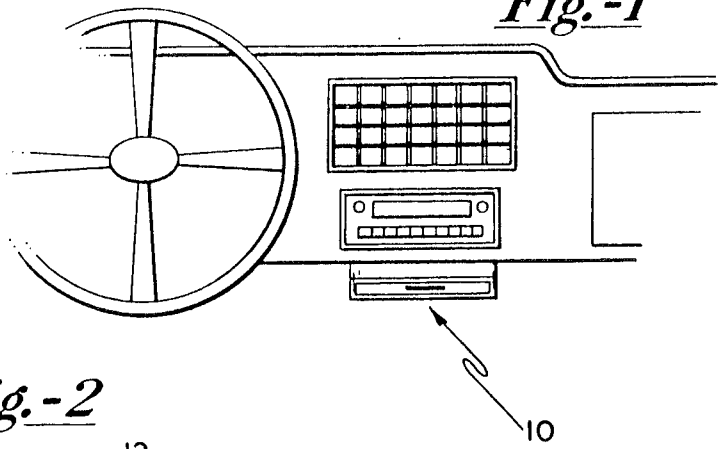
FIG. 1 is a front view of the lottery card scratch tray in its storage position, located under the dash-board of an automobile.

Turning to FIG. 1, it is seen that the lottery ticket scratch tray 10 is, when in its stored position, removably fixed to an out-of-the-way area of the automobile, such as, for example, under the dash board. The tray is affixed to said area via a hook-and-loop fastening system. Hook and loop fastening systems are commercially available.

Figure 2:
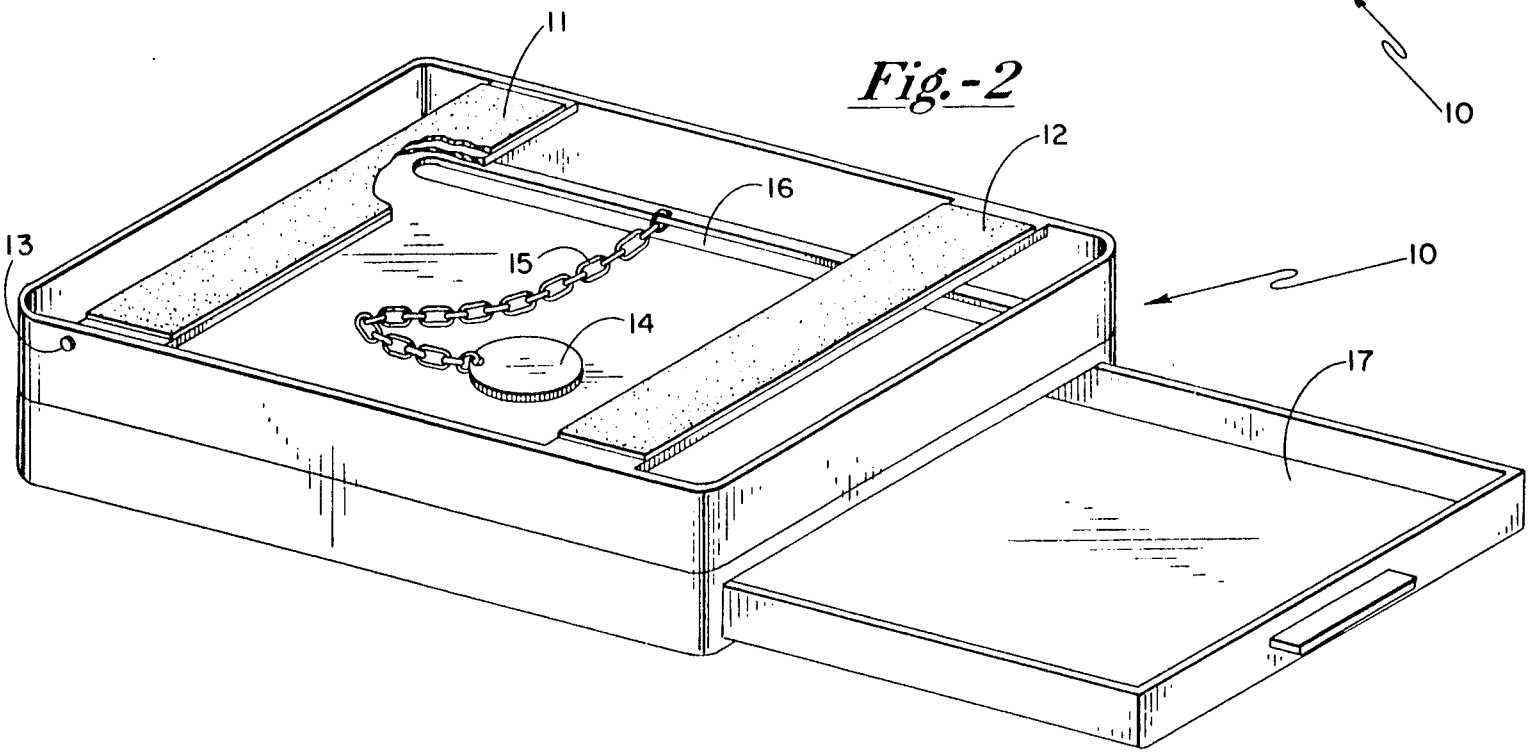
FIG. 2 is a perspective view of the tray revealing a retractable drawer for storing residue from scraped tickets, with the residue being deposited into the tray drawer through the depicted slot running lengthwise down the tray; along with two strips of solid material containing, on their surfaces, either the hook or loop portion of a hook and loop fastening system; with one of the strips being supported by two pins thus forming a movable hinge; along with a scraping device permanently attached to the tray via a chain or similar device.
Figure 3:
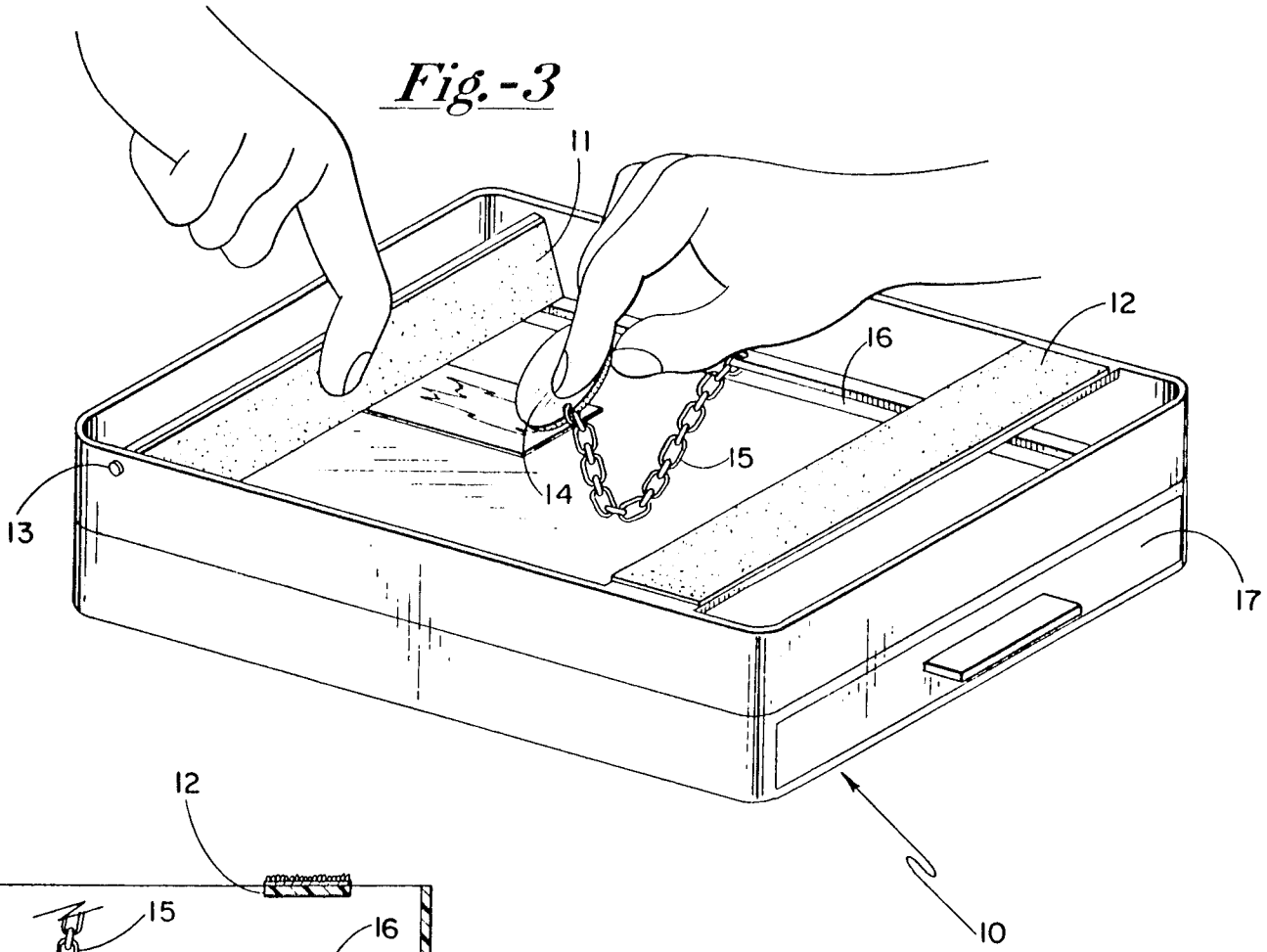
FIG. 3 is a perspective view of the tray in operation, including a depiction of the hinged strip in its actuated position.
Figure 4:
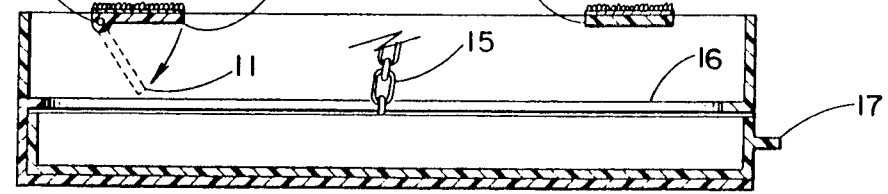
FIG. 4 is a breakaway view of the tray, revealing the operation of the hinged strip.

FIG. 2 depicts the basic tray. The tray portion 10 is preferably comprised of molded plastic. Contained on the device are two solid strips 11 and 12 comprised of, for example, plastic, these strips having either the hook or loop portion of a hook-and-loop fastening system permanently affixed to them. This arrangement allows storage of the tray in a convenient and inconspicuous area of the automobile.

Solid strip 11 is equipped with a pin means, 13, which allows the strip to be rotated in such a way that it becomes a securing device for holding said lottery ticket or tickets in place while being scraped.

The pin portion of the pin means 13 is of a size which allows solid strip 11 to be easily rotated while maintaining a snug fit within the lip portion of the tray, thereby allowing solid strip 11 to be stationarily placed in a position identical to solid strip 12 when the user desires to store the tray via use of the hook and loop fastening system.

Also incorporated into the tray is a scraping device, 14, used to scrape the opaque layer from the ticket or tickets. Scraping device 14 is permanently attached to the tray via a chain or similar device 15.

Contained and formed within the base of the tray is a slot, 16, into which debris such as the removed opaque layer of the ticket or tickets may be deposited. Beneath this slot is a slidable drawer, 17, which may be used to receive and store the debris from several spent tickets prior to being removed and cleaned.

This invention has been described in its presently contemplated best mode, and it is clear that it is susceptible to numerous modifications, modes, and embodiments within the ability of those skilled in the art and without the exercise of inventive facility. Accordingly, the scope of this invention is defined by the scope of the following claims.

What is claimed is:

1. A lottery card scratch tray and mounting means therefore comprised of, in combination:

(A) a smooth base surface, generally rectangular in shape, completely surrounded by a lip;

(B) two solid strips at either end of said tray with each strip having either a hook or a loop portion of a hook-and-loop fastening system affixed to its outer surface;

(C) said mounting means being comprised of two additional strips of either the hook or loop portion of a hook-and-loop fastening system, said additional strips being affixed to a conveniently located area of an automobile, said hook-and-loop fastening system being provided to make it possible to store said tray via affixation of the hook-and-loop portions of said hook-and-loop fastening system;

(D) said two solid strips being comprised of one solid strip permanently and rigidly affixed to said lip, and one solid strip being affixed to a rotatable pin shaft, said rotatable pin shaft being fit securely into said lip so as to allow rotation of said solid strip, said rotatable pin shaft being used to rotate said solid strip downwardly, said downwardly rotation allowing a user to securely hold one or more tickets to said smooth base surface.

2. The tray described in claim 1, wherein said smooth base surface of said tray contains an open slot formed therein and extending parallel to one side of said tray, said open slot being capable of receiving residue from spent lottery tickets; and wherein said tray contains a retractable drawer said drawer being located beneath said slot in said tray, said drawer being used as a waste receptacle for debris deposited into said slot, said retractable drawer being further adapted to be completely removed from said tray.

* * * * *